US005950727A

United States Patent [19]

Irani

[11] Patent Number: 5,950,727

[45] Date of Patent: Sep. 14, 1999

[54] METHOD FOR PLUGGING GAS MIGRATION CHANNELS IN THE CEMENT ANNULUS OF A WELLBORE USING HIGH VISCOSITY POLYMERS

[76] Inventor: Cyrus A. Irani, 7718 Stonesdale, Houston, Tex. 77095

[21] Appl. No.: 08/911,479

[22] Filed: Aug. 14, 1997

Related U.S. Application Data

[60] Provisional application No. 60/024,420, Aug. 20, 1996.

[51] Int. Cl.[6] ..... E21B 33/13

[52] U.S. Cl. ..... 166/270; 166/295; 166/300; 166/403

[58] Field of Search ..... 166/292, 294, 166/295, 300, 270, 270.2, 285, 403; 523/130

[56] References Cited

U.S. PATENT DOCUMENTS

| | | | |
|---|---|---|---|
| 3,847,722 | 11/1974 | Kistner | 166/295 X |
| 4,130,165 | 12/1978 | Fast et al. | 166/294 |
| 4,232,741 | 11/1980 | Richardson et al. | 166/292 |
| 4,569,393 | 2/1986 | Bruning et al. | 166/295 X |
| 4,640,361 | 2/1987 | Smith et al. | 166/288 |
| 4,643,255 | 2/1987 | Sandiford et al. | 166/295 |
| 4,785,883 | 11/1988 | Hoskin et al. | 166/270 |
| 4,828,029 | 5/1989 | Irani | 166/268 |
| 4,844,163 | 7/1989 | Hazlett et al. | 166/270 |
| 4,856,588 | 8/1989 | Bochardt | 166/294 |
| 4,899,817 | 2/1990 | Djabbarah | 166/252 |
| 4,903,767 | 2/1990 | Shu et al. | 166/270 |
| 4,913,235 | 4/1990 | Harris et al. | 166/273 |
| 4,921,576 | 5/1990 | Hurd | 166/252 |
| 4,945,989 | 8/1990 | Irani et al. | 166/268 |
| 4,945,990 | 8/1990 | Irani et al. | 166/268 |
| 4,947,933 | 8/1990 | Jones et al. | 166/263 |
| 5,095,984 | 3/1992 | Irani | 166/268 |
| 5,259,453 | 11/1993 | Johnston | 166/295 |
| 5,421,410 | 6/1995 | Irani | 166/294 |

OTHER PUBLICATIONS

"Transporting Mobility Control Agents to Thief Zones," C.A. Irani, consult, and R.A. Easterly, K&A Energy Consultants, pp. 11–17, SPE 1994.

*Primary Examiner*—Roger Schoeppel

*Attorney, Agent, or Firm*—Haynes and Boone, L.L.P.; Rita M. Irani

[57] ABSTRACT

A process for mitigating the effects of gas migration through channels in a cement sheath in a hydrocarbon production well by injecting a mixture of a carrier fluid with a dissolved polmer into the sheath and dropping the polymer out of solution to form polymers to plug the channels. The process utilizes the phase transition parameters of the mixture coupled with well conditions and/or injection parameters to cause the polymer to drop out of solution within the gas migration channels. The mixture can be injected through well perforations in the producing zone or perforations made in the wellbore adjacent the gas migration zone or directly into the cement sheath at the wellhead.

13 Claims, No Drawings

METHOD FOR PLUGGING GAS MIGRATION CHANNELS IN THE CEMENT ANNULUS OF A WELLBORE USING HIGH VISCOSITY POLYMERS

This application claims the benefit of U.S. Provisional Application Ser. No. 60/024,420, filed Aug. 20, 1996.

FIELD OF THE INVENTION

This invention relates to a method for plugging fractures or passageways in the cement annulus of a well bore. In particular, this invention relates to the transport of permeability reducing agents into the set cement by injecting a plugging agent into the cement using gas or low viscosity fluid to carry the plugging agent into the fractures or passageways.

BACKGROUND OF THE INVENTION

During the drilling and completion stage of an oil or gas producing well, it is customary to introduce a metal pipe referred to as a casing into the hole being drilled to create an annular space between the metal pipe and the open hole representing the formation being drilled. As the drilling operation proceeds, the casing size is reduced in two or more deliberate steps so that the surface casing is the largest diameter and the final casing in the producing intervals is the smallest diameter. To fill the void between the outermost casing wall and the boundary of the drilled hole, it is routine practice to flow a sufficient volume of cement slurry down the casing and return it back up the annular space between the casing and the formation to completely fill the annular space with cement slurry. When hardened, the cemented annulus provides a cement column which serves to support and localize the metal casing, protects the casing from corrosion, and most significantly, seals the annulus from fluid flow between producing intervals, and between a producing interval and the surface.

Prior to the completion of the hardening process, the cement goes through a number of distinct steps including the initial placement of the cement slurry, the gelation or transition state of the slurry, and then the final set condition of the cement. During the gelation step the volume of the cement decreases slightly. The combination of gelation and shrinkage causes a decline in the hydrostatic pressure exerted by the cement column. This loss of hydrostatic head allows the influx of gas from permeable formations into the still gelling cement forming channels for gas to migrate between formation zones or between a zone and the surface. i,e a gas migration problem.

Another undesirable effect of this loss of hydrostatic head is the separation of the cement bond from the casing and/or the formation. This lost bonding also causes a gas migration problem by providing another mechanism for communication between formation zones through the annulus As a consequence of these various mechanisms, vertical fractures and channels develop in the setting cement that allow for inter-zone fluid migration and fluid migration between producing zones and the surface. No gas migration through or around the cement column is acceptable because inter-zone gas communication can lead to significant loss of hydrocarbons to non-producing formations. In addition, gas migration to the surface can result in a dangerous condition that could cause a loss of the producing well.

In addition to the fractures and channels problem, because no cement mix can be viewed as being truly impermeable in the final hardened form, there is always some inherent residual permeability in the cement column. Although gas migration due to this residual permeability in the cement column can be expected to be significantly lower than the gas migration observed when there are fine fracture paths in the column, it can present gas migration problems sufficient to warrant attempting to address the problem. Singly or in combination, such migration can lead to a condition referred to as excess or positive casing pressure, i.e. pressure on the casing increases due to this fluid influx. The positive casing pressure must be released or relieved before the pressure causes casing collapse.

A number of procedures have been explored to mitigate the circumstances that lead to the undesirable migration paths in and around cement sheaths. The earliest approaches to preventing paths during the cementing process involved physically jarring the casing to help with the settling of the cement to minimize volume losses during the shrinking stage. Another early preventative approach involved injecting pressurized water into the annulus at the surface to attempt to restore lost hydrostatic head during the cement gelation process. Yet another approach involved the direct vibration of the cement using pressure pulses generated by a water pulse generator. A more recent approach replaces the water pulses with air pulses. Cement formulations are also available with special ingredients added in an attempt to minimize the volume shrinkage during the gelling phase.

Despite these efforts to eliminate or minimize channels in and around cement sheaths, thousands of completed gas and oil wells have flawed cement sheaths. In the Gulf of Mexico alone there are thought to be between 8,000 and 11,000 wells displaying a problem of excess casing pressure that needs to be remedied. For underwater wells such as those located in the Gulf of Mexico or in the North Sea off the coast of Great Britain or Norway, casing pressure due to gas build up is particularly problematic due to heightened environmental and safety concerns.

Consequently, there persists a need for a post-cementing remedial step that will address the channels responsible for the gas migration problem. Classically, the remedial step has been a cement squeeze where very fine grained cement is squeezed into the wellbore region with the expectation that this cement slurry will penetrate the offending channels and shut off the gas flow. Apart from the fact that such a cement squeeze is quite expensive, the particle size of the slurry which is being injected limits its ability to penetrate deep into the offending channels. Adding to the problem is the high density of the cement slurry which hinders its vertical mobility. Accordingly, there remains a compelling need to develop a technology that will easily and in-depth penetrate the bulk of the channels that have formed and then effectively plug them off.

My earlier patent, U.S. Pat. No. 5,095,984 offers a unique mechanism for in-depth delivery of a plugging agent to a high permeability thief zone in a formation using a compressed gas phase. This patent, incorporated herein by reference, basically teaches a method of delivering a combination of compressed gas, cosolvent and polymer or surfactant that has been adjusted to be one phase at some specific temperature and pressure conditions, as defined by some specific application or reservoir properties, to a formation in a form that will plug an oil bearing formation if the temperature of the original mixture is raised or the pressure lowered from the conditions where the system has been made one phase. The present invention uses that basic concept to address the problem of gas migration into and through cement sheaths.

SUMMARY OF THE INVENTION

This invention is directed to a method for plugging gas migration channels that exist in oil or gas production wells between producing intervals or between a producing interval and the surface by delivery of physical plugging agents directly to the cracks, fractures, migration channels and/or to in-situ permeability zones that result during normal cementing operations required for the completion of an oil or gas producing or injection well. The method of this invention generally includes dissolving a plug generating agent in a compressed gas or light fluid solvent phase transport medium (hereinafter "carrier fluid") to provide a homogeneous, single phase mixture to be directed either through perforations deep in the well bore, or more directly at the surface of the casing, into channels through which gas migration is occurring. For aid in dissolution, cosolvents can be included in the transport medium.

The invention further includes a mechanism for adjusting the composition of the single phase mixture such that it maintains a single phase condition only until the plugging agent is within the channels to be plugged and then becomes two phase with the plugging agent. In accordance with the invention, the mixture composition can be selected to become two phase using one or more mechanisms such as the mixture encountering a sufficient pressure or temperature change due to a change in the annulus or wellbore environment, subjecting the mixture to an external influence on its pressure or temperature, introducing destabilizing chemicals, introducing a solvent that will dilute the original mixture

BRIEF DESCRIPTION OF THE DRAWING

There is no Drawing with this application.

DETAILED DESCRIPTION OF PREFERRED EMBODIMENTS OF THE INVENTION

As will be better appreciated in light of the following discussion, this invention teaches a method for delivering a plugging agent directly and pervasively throughout a gas migration zone in a cemented oil or gas well having some cement flaws.

The invention in its broadest sense involves the use of a carrier fluid to deliver a plugging agent that will drop out of solution when it is within passageways in a cemented annulus of an oil or gas production well. The plugging agent is preferably a polymer with the primary carrier preferably being carbon dioxide, or nitrogen, or light hydrocarbons (i.e. $C_1$–$C_{20}$) or any combination thereof. The plugging mixture may also include a cosolvent if needed which can be any component intentionally added to the primary carrier fluid that facilitates the dissolution of the polymer into the primary carrier fluid.

A detailed description of the general role and interaction of miscible drive solvents, cosolvents and surfactants in carrying and delivering a plugging agent can be found in my U.S. Pat. No. 4,828,029, the teachings of which are hereby incorporated herein by reference. This detailed description will focus on the particular composition and delivery method for delivering a plugging agent to gas migration channels present in or around a cement sheath.

In accordance with the invention, the carrier—polymer mixture can be delivered to the gas migration channels to be plugged by injecting the mixture down the production tubing and allowing it to move upward through the cement annulus (i.e. bottom-up application) or by injecting the mixture into the cement sheath from the sheath top face (i.e. top-down application).

For the bottom-up application, polymeric plugging agents may be dissolved in a suitable carrier fluid by exploiting as needed the use of a cosolvent to enhance plugging agent miscibility and adjusting the concentration to ensure that plugging agent is just in solution in the carrier fluid in the wellbore at the producing perforations, but immiscible when injected further into the cement sheath surrounding the casing string. The concentration of the cosolvent is adjusted to accommodate the height to which the mixture is required to rise up the cement sheath before phase separation takes place and the plugging agent is deposited.

The exact concentration of carrier fluid, cosolvent and polymer can be adjusted in accordance with the anticipated phase behavior of the system as defined by the polymer type, reservoir temperature and pressure, and anticipated polymer deposition mechanism. This information is readily obtained by undertaking the appropriate phase behavior studies to develop appropriate phase transition lines as identified in FIG. 1 of my U.S. Pat. No. 5,095,984.

For the top-down application, a single phase mixture as identified above is used, but instead of injecting it down the tubing to leave the wellbore at the downhole perforations, the mixture is injected directly into the cement sheath at the wellhead. In this embodiment the plugging mixture penetrates down the offending channels deep into the cement sheath, and, when sufficient penetration has been achieved, the injection pressure is backed off to cause the polymer to drop out of solution to plug the offending channels.

To plug cement channels by injecting the one phase mixture from the top of the cement column down toward the producing zone, the pressure of the injection fluid needs to be as low as possible, at least less than about 2000 psi and preferably less than 500 psi. In addition, the volume of injected fluid can be quite low, since there only needs to be a sufficient amount to carry into the channels the small amount of plugging agent needed to close the micro channels. For those reasons, it is economical and most efficient to use fluids such as ethane, propane or butane which are good solvents directly for appropriate plugging polymers, and also have relatively low vapor pressure which will keep the injection pressure within appropriate ranges for the cement plugging objective. Using one or more of these fluids as the carrier eliminates the need for any cosolvent to maintain the polymer in solution until the injection pressure is deliberately reduced to cause the polymer to drop out of its solution with the carrier fluid.

Because these preferred carrier fluids can be combustible and, with small volumes, the mixture with a plugging polymer may be too viscous to effectively move into the cement microchannels, it may be advantageous to dilute the primary carrier fluid with a non-combustible gas such as nitrogen or carbon dioxide, which will also lower the viscosity of the mixture. It has been found through laboratory sight glass studies that using propane as the primary carrier fluid and polydimethylsiloxane as the plugging polymer, the propane and polymer are completely miscible from near zero to near 100% polymer. Because the vapor pressure of propane is about 200 psi at ambient conditions of 70 degrees Fahrenheit, a one phase mixture rich in propane can be injected into the cement from the surface of the annulus and, after it has penetrated a desired distance, the surface pressure can be lowered down to atmospheric (similar to the bleed requirements of the MMS) to leave behind in the channels into which the polymer has been carried the very viscous polymer that will, by the pressure drop, be caused to fall out of solution with the propane.

It is highly unlikely that the offending channels are all of a uniform dimension. Instead, the channels can be expected to show a gradation in size, with the largest dimension channels being the worst offenders and the severity of the problem tapering off as the dimension of the offending channels shrinks. The dimensions of the channels also dictates the ease with which the homogeneous plugging mixture will penetrate the channels. A mixture of a fixed viscosity will have the least trouble penetrating the largest channels and the greatest trouble penetrating the smallest channels. Consequently, in either the top-down or bottom-up cement channel plugging method, it is advantageous to grade the viscosity of the plugging mixture. In particular, if the plugging mixture starts with a certain viscosity designed to afford easy penetration of the largest channels, then the next successive slug of plugging mixture can be designed to have something lower than the original viscosity, e.g., two thirds of the original viscosity, with the next incremental slug having two thirds again of the previous slug's viscosity, and so on. It may be necessary to use successive slugs with ever decreasing viscosity in four or five staged steps down to some low viscosity capable of penetrating the smallest of the offending channels. By this mechanism, a plugging mixture capable of penetrating all the offending channels can be delivered.

Whether or not a cosolvent is needed will be dictated by the particular application and the extent to which the carrier fluid has been indirectly enriched with heavier hydrocarbon fractions that would be appropriate cosolvents. A cosolvent may be needed only if the primary carrier fluid is carbon dioxide that has not been enriched through contact with reservoir hydrocarbons during oil recovery operations. If it has been so enriched, then it is likely that no additional cosolvent will be needed. Although straight carbon dioxide or methane or nitrogen would be the least expensive carriers for the polymer, because of the low solubility of most polymers in those fluids, they are also the most likely to require a cosolvent. Because so little mixture is required for the top-down application, it may be most advantageous to simply use a carrier which is a good solvent for the polymer and thereby eliminate the need for a cosolvent additive.

For a bottom-up application, where higher pressures are available, a mixture using a carrier fluid like carbon dioxide enriched with a cosolvent might be the more appropriate remedial system. For the top-down application, a system using some light hydrocarbon like ethane, or propane, or butane, or pentane, or mixtures of the same as the carrier fluid is likely to be most effective. The casing at its top surface, i.e. at the wellhead, is restricted in the amount of pressure it can support, and any one of these fluids can be expected to be a good solvent for the plugging agent at much lower pressures than would be required for the case where say carbon dioxide was the carrier fluid.

EXAMPLES

The following examples illustrate the versatility of the system and the way in which the carrier fluid can be selected for particular applications.

Test Procedure #1

In a sight glass apparatus similar to that described in U.S. Pat. No. 4,913,235 and maintained initially at ambient temperature (about 70° F.), a charge of about 4.5 g (about 4.5 cc) of a 1,000,000 cSt (centistokes) polymer was introduced, and then carrier fluid directly added to the polymer at the vapor pressure of the fluid at ambient temperature. To quickly dissolve the polymer in the fluid, the system was pressured up to at least 7,000 psia, and the sight glass rocked. Once the polymer is in solution the rocking was stopped and the following was observed. For these examples, the polymer used was polydimethylsiloxane. For Examples 1 through 3, its viscosity was 1,000,000 cSt; for Example 4, it was 600,000 cSt.

TABLE 1

Example 1: Ethane as the carrier fluid - no cosolvent

| Temperature (° F.) | Pressure (psia) | Polymer Swell Factor | System Condition |
|---|---|---|---|
| 76.7 | 7000 | | Single phase |
| 76.7 | 1185 | | Phase Transition |
| 76.7 | 1162 | 3.8 | Two phases |
| 76.7 | 868 | 2.7 | Two phase |
| 76.7 | 615 | 1.9 | Two phase |
| 76.7 | 570 | 1.8 | Two phase |
| 133 | 7000 | | Single phase |
| 133 | 2345 | | Phase Transition |
| 133 | 2000 | 2.9 | Two phase |
| 133 | 1227 | 1.4 | Two phase |
| 133 | 758 | 1.05 | Two phase |
| 195 | 7000 | | Single phase |
| 195 | 3225 | | Phase Transition |
| 195 | 3050 | 3.2 | Two Phase |
| 195 | 2205 | 1.6 | Two Phase |
| 195 | 1410 | 1.4 | Two Phase |
| 195 | 1010 | 1.05 | Two Phase |

The phase transition condition is equivalent to the observation of critical opalescence where incipient phase separation of the polymer is first observed. The above table illustrates the manner in which a light hydrocarbon like ethane can be used to act as the carrier fluid for a high viscosity polymer. If, for example, the area to be plugged is at a temperature of about 76.7° F., then a solution of the polymer in ethane will need to be maintained above 1185 psia to keep the system above the critical opalescence or phase transition pressure during placement. After placement, the pressure can be lowered to 15 psia to deposit a significantly viscous polymer for plugging action. Similarly the remaining data in the above table identify the minimum pressures required at the higher temperatures of 133° F. and 195° F. to maintain polymer solubility.

The polymer swelling column indicates the extent to which the polymer has swelled beyond its initial volume due to solvent retention as a function of temperature and pressure. Clearly, the lower the pressure is taken, the more solvent is released from the mixture and the more viscous the deposited polymer phase would be. If all the solvent is released from the mixture, say by the means of lowering the pressure to atmospheric, then only viscous polymer will be left behind.

TABLE 2

Example 2 - Propane as the carrier fluid - no cosolvent

| Temperature | Pressure | System Condition |
|---|---|---|
| 76.7 | 4000 | Single phase |
| 76.7 | 130 | Single phase at bubble point |
| 131 | 275 | Single phase at bubble point |
| 183 | 580 | Phase transition |

The use of propane as the carrier fluid allows for lower pressure applications to be feasible. For example, at any temperature of use, propane will allow the polymer to be carried at a lower pressure than ethane. This could be significant from a cost and practicality standpoint. For example, in a top down type application where there is a limitation on how much pressure the casing string can take, being able to deliver the plugging mixture at the lowest pressure possible could be important. Additionally, the cost of the equipment required and the complexity of the procedure increases as the required injection pressure increases because high pressures require more robust equipment and the equipment is more prone to leaks and failure.

TABLE 3

Example 3 - Butane as the carrier fluid - no cosolvent

| Temperature | Pressure | System Condition |
|---|---|---|
| 76.7 | 37 | Single phase at bubble point |
| 131 | 82 | Single phase at bubble point |
| 183 | 170 | Single phase at bubble point |
| 242 | 305 | Single phase at bubble point |
| 328 | 840 | Phase transition |

Continuing the pattern established in the previous two examples, butane is seen to be a better solvent than propane or ethane in terms of both the lower pressures and the higher temperatures at which polymer solubility is observed. It should be kept in mind for all three cases that reducing the pressure to atmospheric by allowing the gas to bleed off will always deliver an extremely viscous polymer phase.

As can now be appreciated, each of the three example systems has unique advantages depending on the particular application. Take for example, the case where the application temperature is 76.7° F., but for whatever reason the lowest pressure the system can be drawn down to is 100 psi. At these conditions butane will remain liquid and the polymer will stay in solution. However, if ethane or propane are used as the carrier, both fluids are below their respective bubble point pressures at this temperature, and both systems can be expected to lose solvent and deposit a viscous polymer. Correspondingly, if the minimum application pressure is 400 psia, ethane is likely to be the only carrier fluid needed.

Because the smaller the size of the molecule the lower the viscosity of the fluid, at any given conditions of temperature and pressure, ethane will have an advantage over propane, and propane over butane. The advantage comes from the fact that the channels to be plugged are extremely fine and will not readily take fluids and certainly not very viscous fluids. Adding the polymer to the carrying fluid will increase the viscosity of the mixture over that of the base carrying fluid, and consequently, the lower the starting viscosity of the carrying fluid the more polymer can be added to it under comparable conditions for transport to the offending channels.

The application is not limited to these three carrier fluids alone. Mixtures of any of them with gases like nitrogen or carbon dioxide or methane can enhance the performance of the system in particular applications. For example, where the viscosity of the injected fluid needs to be lowered, inclusion of these gases will not only lower mixture viscosity but will also modify its phase behavior enabling the system to be adapted to a wide variety of field and well conditions.

Example 4

Carbon Dioxide as the Carrier Fluid—with Cosolvent

This example describes the use of this technology with a carrier phase like carbon dioxide which for most usual applications will need a cosolvent to dissolve the polymer. Furthermore, this example will demonstrate how this technology can be used in a real application to seal off gas migration channels in a simulated model duplicating the actual process.

Test Procedure #2

For this example, a model specifically designed to investigate the formation and remediation of cement sheath channels was built. The model was a ten foot long column that was first prepared and then charged with a cement slurry for testing. While the cement was hardening, a small but steady stream of gas was allowed to percolate through the hardening slurry in order to deliberately allowing gas channels to form.

In its final hardened state, nitrogen at 130 cc/min flowed through the column at a pressure differential of 10.3 psi, for a calculated permeability of 972 millidarcies (md), as shown in the first line of Table 4 below. This test was intentionally made to simulate an extreme case of a cement sheath with migration channels. In practice, a typical permeability for a cement sheath with gas channeling problems might be more in the 200 md range. If the system works in the extreme case, then it will work in the more typical case where channeling needs to be addressed.

The plugging mixture used in this procedure comprised 80 wt. % carbon dioxide ($CO_2$), 10 wt. % toluene as cosolvent, and 10 wt. % of a 600,000 cSt polydimethylsiloxane polymer as the plugging agent. Using sight glass observations as above, it was found that, at ambient temperature, the two phase transition pressure of the system was in the range of 1750 psia. Therefore, for the plugging test, the hardened cement model with migration paths intact was slowly raised in pressure to 2500 psia while injecting a $CO_2$-toluene buffer mixture. The buffer mixture is injected to ensure that the plugging mixture will not destabilize at its leading edge due to dilution with a gas that cannot solubilize the polymer.

With the leading edge protected, the plugging mixture was then injected into the model, and injection continued until polymer was observed at the low pressure discharge from the top of the model. The model was now shut in at the bottom and the pressure in the model slowly bled to atmospheric from the top to force destabilization of the plugging mixture and deliver polymer in the migration channels at maximum viscosity After the polymer delivery procedure was completed, plugging effectiveness was tested by flowing nitrogen through the system which yielded the results shown in Table 4 below.

TABLE 4

| Pressure Difference (psi) | Flow Rate (cc/min) | Permeability (md) |
|---|---|---|
| 10 | 130 | 972* |
| 10 | 0.2 | 1.4 |
| 20 | 3.1 | 9.5 |
| 30 | 14.5 | 25 |
| 40 | 34.8 | 38 |
| 50 | 7.9 | 52 |

TABLE 4-continued

| Pressure Difference (psi) | Flow Rate (cc/min) | Permeability (md) |
|---|---|---|
| 60 | 120.5 | 69 |
| 70 | 193.2 | 85 |

*Unplugged cement column.

These results demonstrate that significant plugging of the gas migration channels was achieved by this mechanism. At the original 10 psi differential nitrogen flow rate, the permeability had been reduced from 972 md to 1.4 md., and the permeability remained significantly below the original measured value even when the pressure differential for nitrogen injection was increased seven fold.

Procedure for Plugging in the Field

In a real field situation where a well is to be plugged and abandoned, for a bottom up application, the plugging mixture would be injected down the tubing string to the lowest layer of perforations, having first established that these perforations were in contact with the offending gas channels. The plugging mixture would be allowed to rise up the cement sheath filling the annular space between the casing string and the formation.

In many field applications, it may not be necessary to take any action to cause the plugging mixture to experience a pressure drop or temperature change sufficient to cause the plugging action. That is because, as the plugging mixture flows vertically up the migration paths, the pressure of the system will slowly fall due to loss of hydrostatic head, and when the pressure approaches the destabilization pressure, the polymer will start precipitating as finely dispersed droplets. Depending on the size of the droplets the fine dispersion may continue to move up through the channels until the pressure drops sufficiently to cause the droplet size to be sufficiently large to start the required plugging action. Where the polymer does not of its own accord drop out of solution, temperature or pressure changes can be induced to cause that to occur when the plugging mixture has traversed a sufficient height to be within the gas migration channels to be plugged. Another mechanism for activating the plugging action might be to bleed the pressure in the annular space at the surface of the wellhead—a technique currently practiced in the field to reduce the pressure behind the casing.

However, if remedial action is required during an ongoing production operation, specific steps might be needed to implement the workings of this invention with minimal damage to the oil producing zones. In those situations, it may be necessary to pack off the producing well just above the uppermost producing perforations and to add a new set of perforations above the packer for injecting the plugging mixture. Then, with the packer in place, the mixture can be injected at a pressure sufficient as to cause the mixture to flow into the cement sheath and then flow up the channels that are responsible for the gas migration problem.

As can now be appreciated, with the basic understanding of the plugging mechanism and test parameters described above, the invention can be adapted for a variety of production and cement annulus conditions. For example, with the bottom up approach, as the plugging fluid moves up within the channels of the annulus from the perforations, there will be a pressure drop which will eventually be sufficient for the polymer to drop out of its solution with the carrier fluid. The carrier fluid behind the plug will still be available to travel into smaller channels carrying with it additional plugging polymer which will drop out of solution when the pressure in the smaller channel reaches the destabilization pressure. In this manner, successively smaller channels will be plugged until no more channels are available, at which point injection of the plugging fluid can be stopped.

Understandably, sufficient amounts of this plugging mixture will need to be injected to ensure that a high percentage of the volume making up the migration channels are occupied. The volume of space to be plugged can be conservatively calculated by one skilled in the art from a knowledge of the volume of cement used to fill the annulus and its apparent permeability. It is believed that a conservative estimate of between about 0.1% and 30% of the total cement volume would represent a minimum and maximum volume of the migration channel space. This initial estimate is not critical, however, because, as noted in the beginning of this discussion, the procedure can be repeated a number of times to ensure that the desired amount of plugging has been implemented in order to curtail gas migration.

As can be appreciated, although the above description and examples focuses on pressure as the primary destabilizing mechanism for causing the polymer plugging, other mechanisms are readily available such as temperature and solubility changes, for causing the polymer to precipitate out from the plugging fluid.

Finally as the above examples demonstrate, further adaptability to various field conditions is available by selection of the suitable polymer. Examples 1, 2 and 3 above exploited a 100,000,00 cSt (at 77° F.) polymer, while Example 4 worked with a 600,000 cSt. polymer. As demonstrated by the above examples, the higher molecular weight 1,000,000 cSt polymer is as practical to use as the lower molecular weight 600,000 cSt polymer. For that reason siloxane polymers that are classified as gums and have a nominal viscosity in the 1,500,000 cSt and higher range can be used. In specific cases where excessively high gas pressures may be present in the channels, or where the migration paths are so wide that they need a high polymer viscosity plug, these gums might be the polymer of choice in the plugging system of the invention. Furthermore, even though this treatment has focused on the use of the polydimethylsiloxane polymers, once the transition to carrying fluids like propane is made, the strong solvent characteristics of ethane, propane, butane, pentane etc and admixtures of the same open up a much wider range of polymers for this application. For example, a polymer like polystyrene which is much more difficult to dissolve and use when carbon dioxide is the carrier gas, become much more practical when ethane, propane or butane is the carrier gas and a gas like carbon dioxide is included for reasons of phase behavior or viscosity modification.

As can now be appreciated, the basic invention involves the use of a carrier fluid to carry a polymer into the channels formed in the cement sheath placed in the annular space formed between casing and formation, and then exploiting either temperature or pressure or some chemical effect to drop the polymer out of solution in the carrier fluid to physically plug the channels through which gas migration is taking place.

The foregoing disclosure and description of the invention are illustrative and explanatory thereof, and various changes in the materials and procedure may be made without departing from the spirit of the invention, the scope of which is defined by the following claims.

What is claimed is:

1. A method of plugging gas migration channels in a cement sheath having microchannels therein, surrounding a hydrocarbon production well, the method comprising:

mixing a carrier fluid selected from the group consisting of a hydrocarbon in the carbon number range of from C2 through C10 with a viscous polymer to create a liquid mixture having a predetermined viscosity; and injecting the mixture into the cement sheath at a pressure sufficient to keep the mixture a homogenous liquid.

2. The method of claim 1 wherein the polymer comprises polydimethysiloxane.

3. The method of claim 2 wherein the polymer has a viscosity at ambient temperature of at least about 500 cSt.

4. The method of claim 1 wherein the polymer comprises polystyrene.

5. The method of claim 4 wherein the polymer has a viscosity at ambient temperature of at least about 500 cSt.

6. The method of claim 1 wherein the polymer is selected from the group consisting of polyethylene, polypropylene and polybutylene.

7. The method of claim 6 wherein the polymer has a viscosity at ambient temperature of at least about 500 cSt.

8. The method of claim 1 wherein the mixture is injected into the cement sheath adjacent the formation.

9. The method of claim 1 wherein the mixture is injected into the top surface of the cement sheath.

10. The method of claim 1 wherein the mixing step includes mixing a series of discrete liquid mixtures have a series of discrete predetermined viscosities and wherein the injecting step includes sequentially injecting the series of mixtures beginning with the highest predetermined viscosity mixture and ending with the lowest predetermined viscosity mixture.

11. The method of claim 1 wherein the carrier fluid is ethane.

12. The method of claim 1 wherein the carrier fluid is propane.

13. The method of claim 1 wherein the carrier fluid is butane.

* * * * *